US009354561B1

(12) United States Patent
Oi et al.

(10) Patent No.: US 9,354,561 B1
(45) Date of Patent: May 31, 2016

(54) IMAGE FORMING APPARATUS AND LIGHT GUIDE MEMBER

(71) Applicant: KYOCERA Document Solutions Inc., Osaka-shi, Osaka (JP)

(72) Inventors: Hironobu Oi, Osaka (JP); Jun Nakai, Osaka (JP); Yosuke Saito, Osaka (JP); Yoshinori Nakamura, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/973,597

(22) Filed: Dec. 17, 2015

(30) Foreign Application Priority Data

Dec. 26, 2014 (JP) ..... 2014-265119

(51) Int. Cl.
*G03G 21/00* (2006.01)
*G03G 15/16* (2006.01)

(52) U.S. Cl.
CPC ..... *G03G 15/169* (2013.01); *G03G 21/00* (2013.01)

(58) Field of Classification Search
CPC ..... G03G 15/169; G03G 21/00
USPC ..... 399/128, 129, 296
See application file for complete search history.

(56) References Cited

U.S. PATENT DOCUMENTS

2013/0136499 A1 5/2013 Kamiyama

FOREIGN PATENT DOCUMENTS

JP 2003005535 A * 1/2003
JP 2003295717 A 10/2003
JP 2013113901 A 6/2013

* cited by examiner

*Primary Examiner* — Susan Lee
(74) *Attorney, Agent, or Firm* — Alleman Hall McCoy Russell & Tuttle LLP

(57) ABSTRACT

In a light guide member included in an image forming apparatus, a transmitting/reflecting portion transmits and reflects light that is emitted from a light source to enter one end of the light guide member in a longitudinal direction and be guided to the other end thereof in the longitudinal direction. The light reflected by the transmitting/reflecting portion is emitted from a first optical surface. The light transmitted through the transmitting/reflecting portion is emitted from a second optical surface. At a cross section orthogonal to the longitudinal direction, a first outer peripheral surface has an arc shape including the first optical surface. Second outer peripheral surfaces expand from both ends of the first outer peripheral surface toward the second optical surface.

10 Claims, 14 Drawing Sheets

IMAGE FORMING APPARATUS AND LIGHT GUIDE MEMBER

INCORPORATION BY REFERENCE

This application is based upon and claims the benefit of priority from the corresponding Japanese Patent Application No. 2014-265119 filed on Dec. 26, 2014, the entire contents of which are incorporated herein by reference.

BACKGROUND

The present disclosure relates to an electrophotographic image forming apparatus and a light guide member used in the electrophotographic image forming apparatus.

In an electrophotographic image forming apparatus, a photosensitive drum is uniformly charged by a charging roller. Next, laser light is applied to a surface of the charged photosensitive drum, and thus an electrostatic latent image is formed on the surface of the photosensitive drum. Then, the electrostatic latent image on the photosensitive drum is developed by using toner. Then, after the toner image on the photosensitive drum is transferred onto a transfer target member such as a sheet or an intermediate transfer belt, the photosensitive drum is discharged by discharging light emitted from a discharging portion, and the surface of the photosensitive drum is cleaned by a cleaning portion.

In some cases, a discharging portion, which applies discharging light to the photosensitive drum before transfer of the toner image on the photosensitive drum onto the transfer target member, is provided. Further, a configuration is known in which light emitted from a light source is reflected, by a light guide member having two reflection surfaces, toward: a position at which a toner image has been transferred and which is a position of a photosensitive drum on an upstream side in a traveling direction of the transfer target member; and a position at which a toner image has not been transferred and which is a position of a photosensitive drum on a downstream side in the traveling direction of the transfer target member. A configuration is also known in which grooves each having a triangular cross section are arranged in parallel over the entirety of an elongated light guide member having a cylindrical shape, along its longitudinal direction, and incident light is guided as the discharging light toward a photosensitive drum by the grooves.

SUMMARY

An image forming apparatus according to an aspect of the present disclosure includes a plurality of image carriers, a developing roller, a transfer roller, a cleaning portion, a light source, and an elongated light guide member. The plurality of image carriers are arranged along a traveling direction of a transfer target member. The developing roller develops, as a toner image, an electrostatic latent image formed on each image carrier. The transfer roller transfers the toner image formed on each image carrier onto the transfer target member. The cleaning portion cleans each image carrier after the toner image is transferred onto the transfer target member by the transfer roller. The light source emits light used to discharge each image carrier. The light guide member has an elongated shape. The light guide member includes a transmitting/reflecting portion, a first optical surface, a second optical surface, and first and second outer peripheral surfaces. The transmitting/reflecting portion transmits and reflects light that is emitted from the light source to enter one end of the light guide member in a longitudinal direction and be guided to the other end thereof in the longitudinal direction, so that the light is applied to: a position between the developing roller and the transfer roller on the image carrier on a downstream side in the traveling direction of the transfer target member; and a position between the transfer roller and the cleaning portion on the image carrier on an upstream side in the traveling direction of the transfer target member. The light reflected by the transmitting/reflecting portion is emitted from the first optical surface. The light transmitted through the transmitting/reflecting portion is emitted from the second optical surface. At a cross section orthogonal to the longitudinal direction, the first outer peripheral surface has an arc shape including the first optical surface. At the cross section orthogonal to the longitudinal direction, the second outer peripheral surfaces expand from both ends of the first outer peripheral surface toward the second optical surface.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRΔWINGS

Figure 7A:
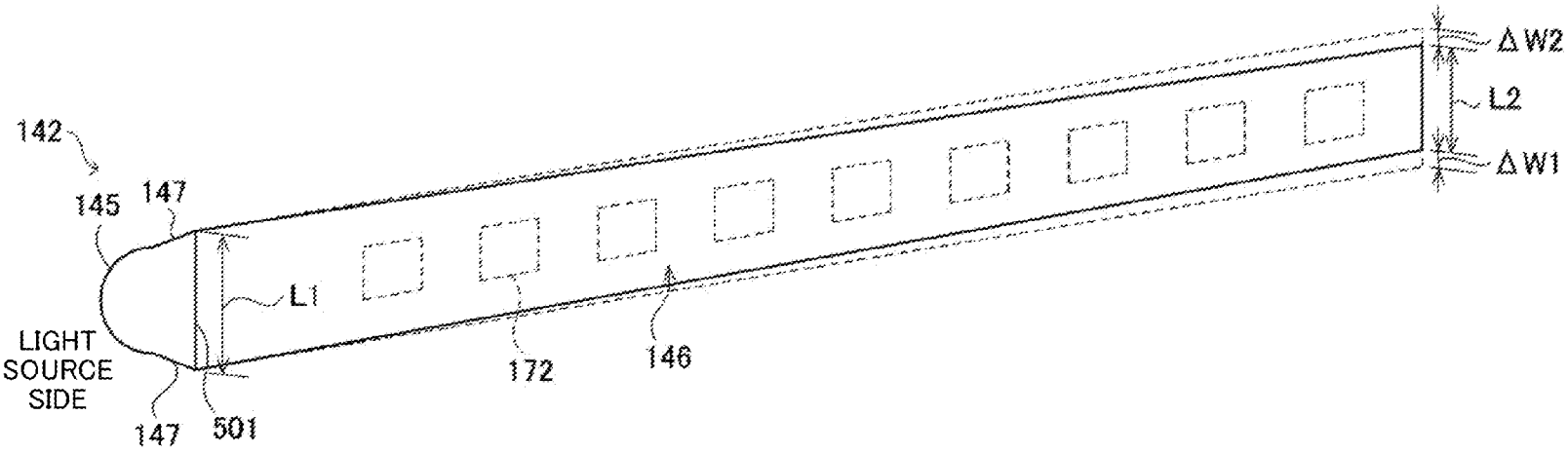
Figure 7B:
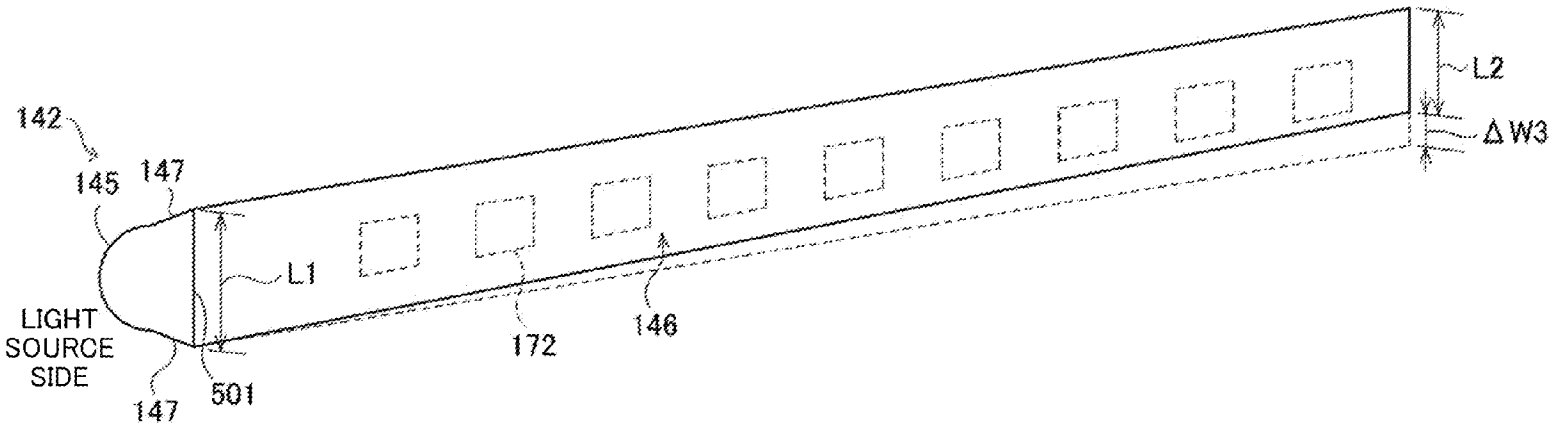
Figure 7C:
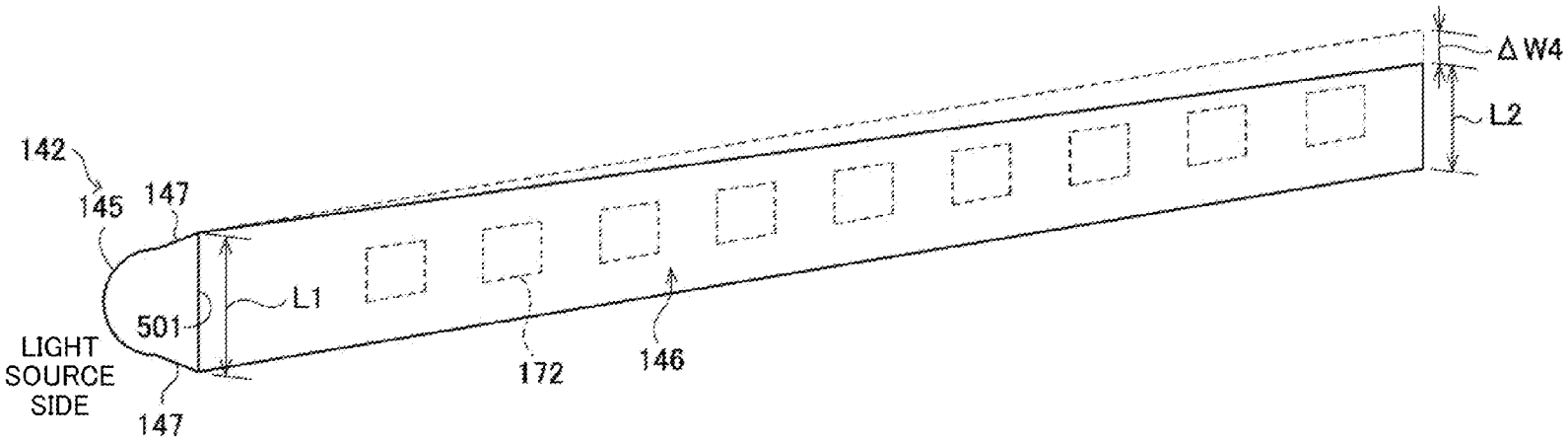

FIG. 7A, FIG. 7B, and FIG. 7C are diagrams illustrating a modification of the light guide member.

Figure 8A:
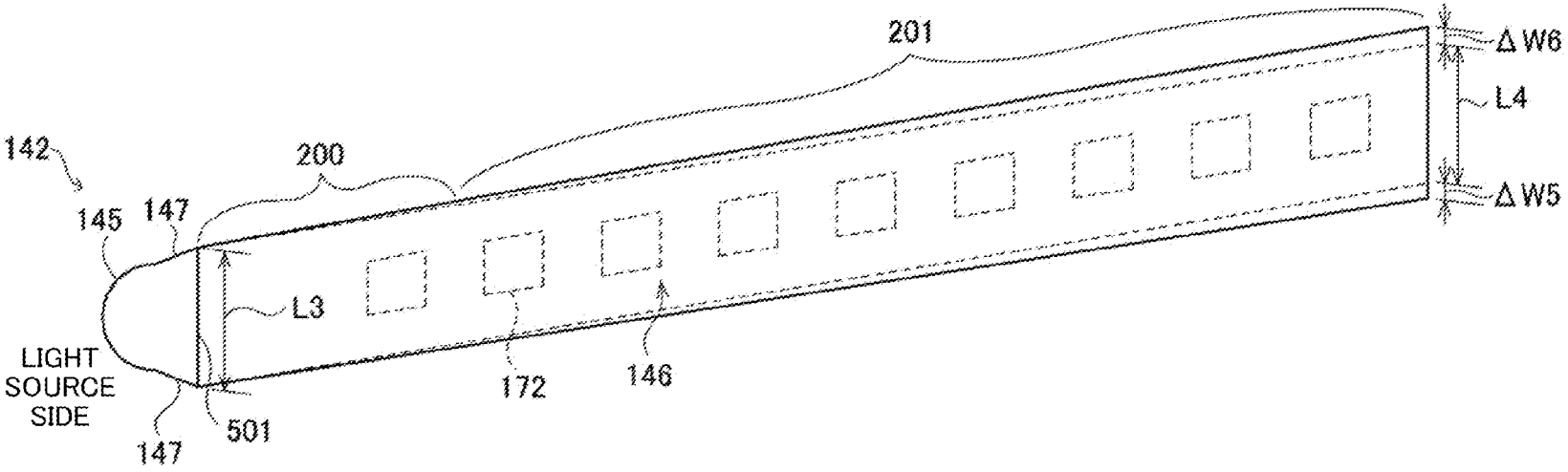
Figure 8B:
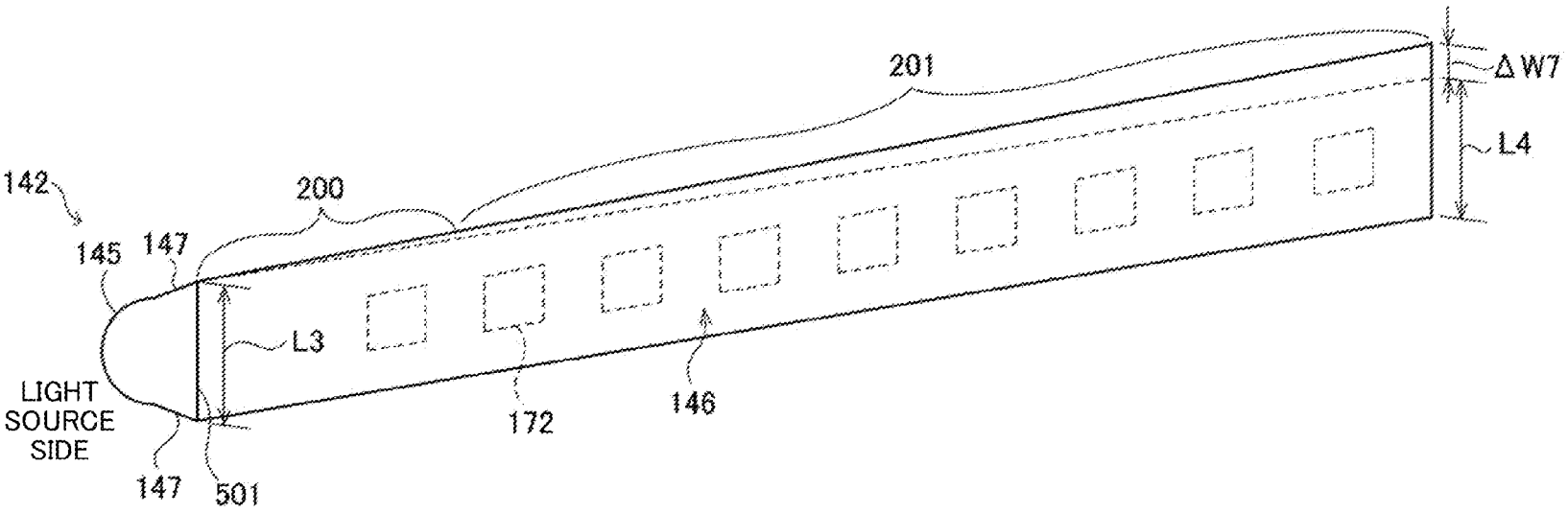
Figure 8C:
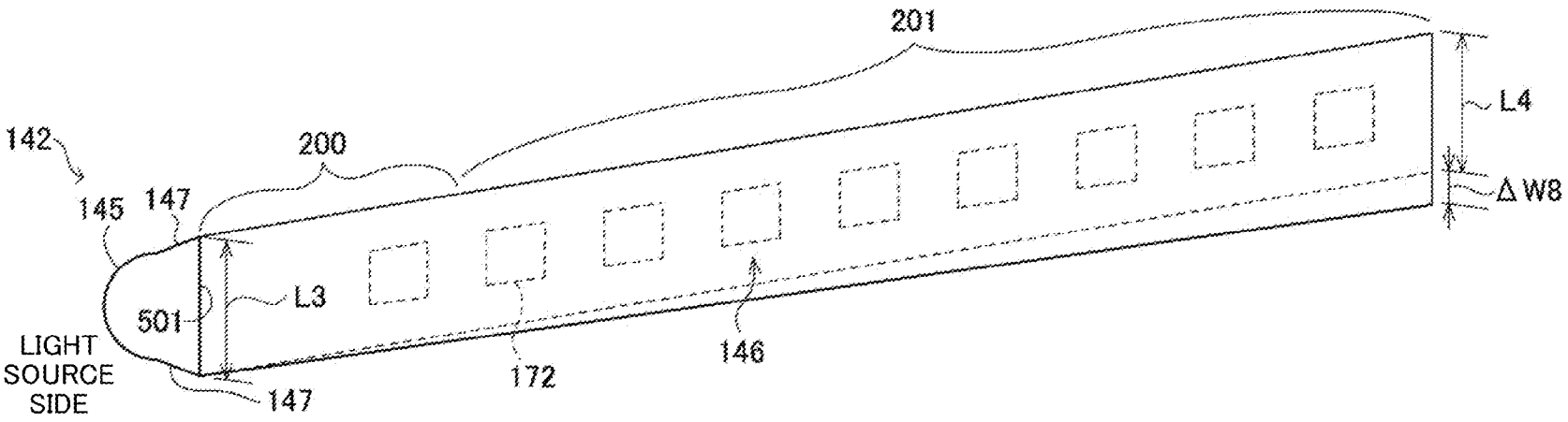

FIG. 8A, FIG. 8B, and FIG. 8C are diagrams illustrating a modification of the light guide member.

Figure 9A:
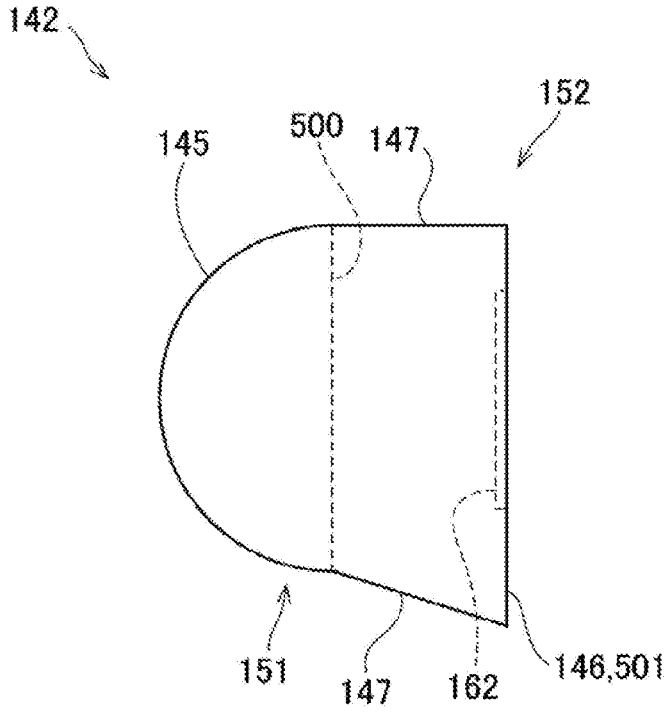
Figure 9B:
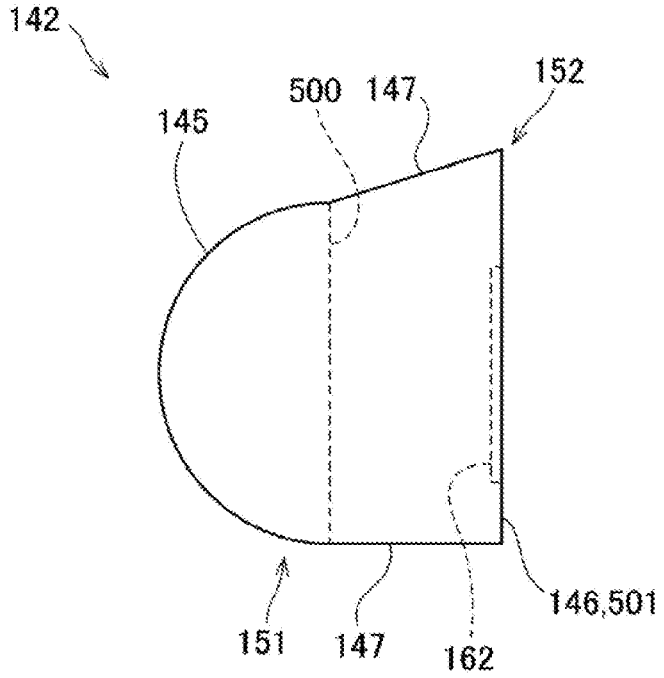

FIG. 9A and FIG. 9B are diagrams illustrating a modification of the light guide member.

DETAILED DESCRIPTION

Figure 1:
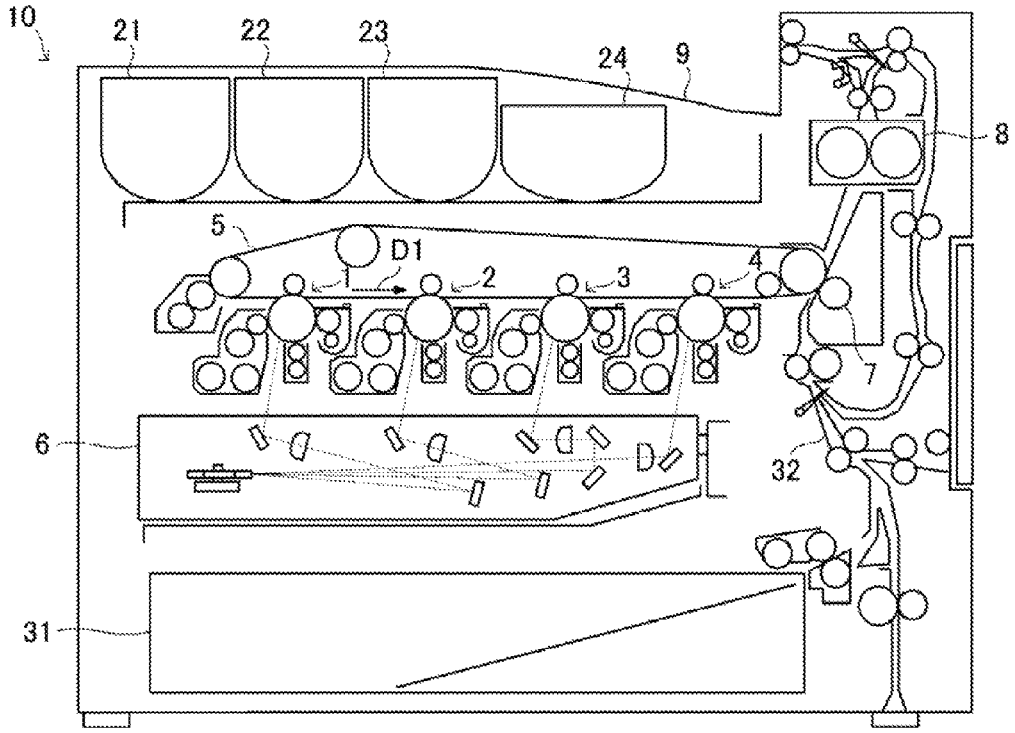
FIG. 1 is a diagram illustrating a configuration of an image forming apparatus according to an embodiment of the present disclosure.

As illustrated in FIG. 1, an image forming apparatus 10 is a printer including a plurality of image forming units 1 to 4, an intermediate transfer belt 5, a laser scanning unit 6, a secondary transfer roller 7, a fixing device 8, a sheet discharge tray 9, toner containers 21 to 24, a sheet feeding cassette 31, a conveyance path 32, and the like.

The image forming units 1 to 4 are arranged along a traveling direction D1 of the intermediate transfer belt 5 and constitute a so-called tandem type image forming portion. Specifically, the image forming units 1, 2, 3, and 4 form toner images corresponding to yellow, magenta, cyan, and black, respectively. Note that a sheet such as a printing sheet may be an example of a transfer target member.

Figure 2:
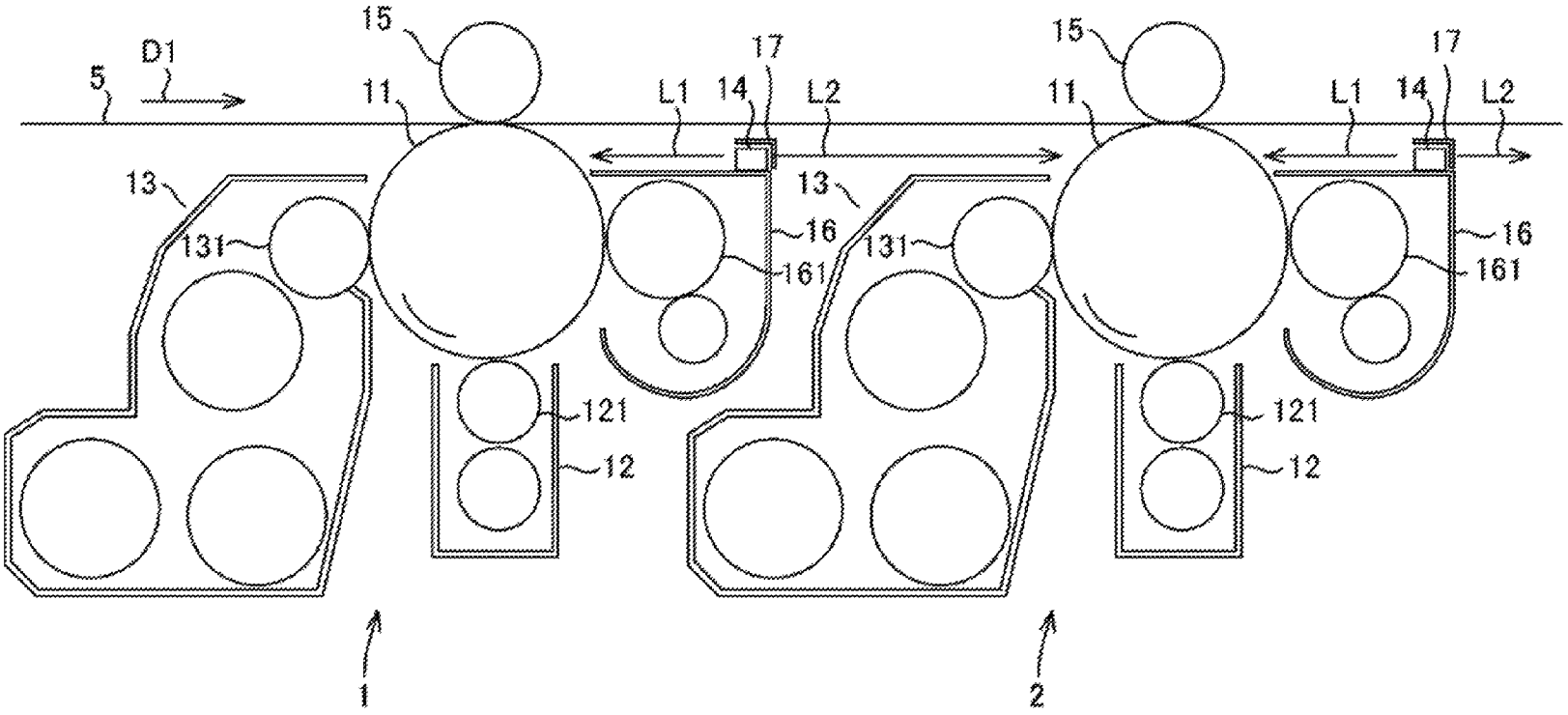
FIG. 2 is a diagram illustrating an example of image forming units of the image forming apparatus illustrated in FIG. 1.
Figure 3:
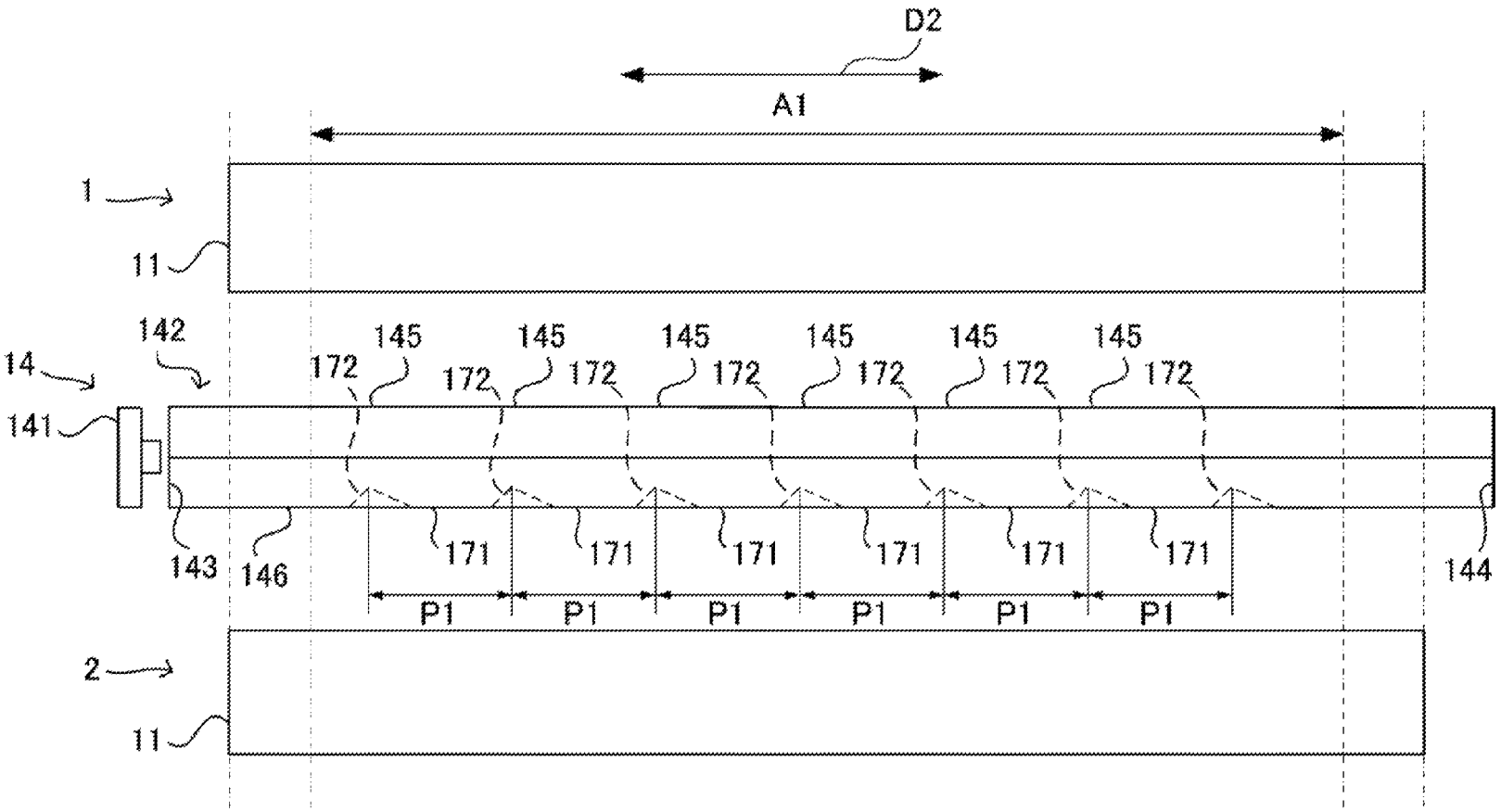
FIG. 3 is a diagram illustrating a discharging portion of the image forming unit illustrated in FIG. 2.

As illustrated in FIG. 2, the image forming unit 1 and the image forming unit 2 are electrophotographic image forming units each including a photosensitive drum 11, and a charging portion 12, a developing portion 13, a discharging portion 14, a primary transfer roller 15, and a cleaning device 16 that correspond to the photosensitive drum 11. Note that the image forming unit 3 and the image forming unit 4 are similar to the image forming units 1 and 2.

The photosensitive drums 11 are arranged along the traveling direction of the intermediate transfer belt 5, and each photosensitive drum 11 is an image carrier that carries an electrostatic latent image and a toner image. Each of the charging portions 12 has a charging roller 121 that charges the photosensitive drum 11 by electric power supplied from a power source (not shown). The laser scanning unit 6 applies laser light to the photosensitive drum 11 charged by the charging portion 12, and thus an electrostatic latent image based on image data is formed on an outer peripheral surface of the photosensitive drum 11. Each of the developing portions 13 has a developing roller 131 that develops the electrostatic latent image formed on the photosensitive drum 11 by using toner (developer).

Each of the primary transfer rollers 15 transfers the toner image formed on the photosensitive drum 11 onto the intermediate transfer belt 5. The intermediate transfer belt 5 is an intermediate transfer member that travels on the photosensitive drums 11 of the respective image forming units 1 to 4 and on which toner images of the respective colors formed on the respective photosensitive drums 11 are sequentially transferred so as to overlap each other. Each of the cleaning devices 16 has a cleaning portion 161 such as a cleaning roller or a cleaning blade that cleans the photosensitive drum 11 after the toner image is transferred onto the intermediate transfer belt 5 by the primary transfer roller 15.

Each of the discharging portions 14 applies discharging light L1 for discharging the photosensitive drum 11 to a position between the primary transfer roller 15 and the cleaning portion 161 on an outer peripheral surface of the photosensitive drum 11 on an upstream side in the traveling direction D1 of the intermediate transfer belt 5. In other words, each of the discharging portions 14 applies the discharging light L1 to a position that is, in a rotation direction of the photosensitive drum 11, on a downstream side of the primary transfer roller 15 and on an upstream side of the cleaning portion 161. Furthermore, each of the discharging portions 14 applies discharging light L2 for discharging the photosensitive drum 11 to a position between the developing roller 131 and the primary transfer roller 15 on an outer peripheral surface of the photosensitive drum 11 on a downstream side in the traveling direction D1 of the intermediate transfer belt 5. In other words, each of the discharging portions 14 applies the discharging light L2 to a position that is, in the rotation direction of the photosensitive drum 11, on a downstream side of the developing roller 131 and on an upstream side of the primary transfer roller 15. A so-called memory image of the photosensitive drum 11 is suppressed by discharging the photosensitive drum 11 before and after transfer of the toner image of the photosensitive drum 11 onto the intermediate transfer belt 5.

Since a yellow image is not noticeable, the problem of occurrence of an image memory hardly become evident even if the discharging light L2 is not applied to the photosensitive drum 11 of the image forming unit 1 that corresponds to yellow. Therefore, in the image forming apparatus 10, a discharging portion 14 that applies discharging light L2 to the photosensitive drum 11 of the image forming unit 1 is omitted. That is, in the image forming apparatus 10, the photosensitive drum 11 disposed on the most upstream side in the traveling direction D1 is one that corresponds to yellow, and the discharging portion 14 including a light source 141 and a light guide member 142 is disposed only at positions on the downstream side of the respective photosensitive drums 11 in the traveling direction D1. Needless to say, it is also conceivable that the image forming apparatus 10 includes a discharging portion 14 that applies the discharging light L2 to the photosensitive drum 11 of the image forming unit 1.

Next, the discharging portion 14 is described with reference to FIGS. 3 to 6.

The discharging portion 14 is disposed between the photosensitive drum 11 disposed on the upstream side in the traveling direction D1 of the intermediate transfer belt 5 and the photosensitive drum 11 disposed on the downstream side in the traveling direction D1 of the intermediate transfer belt 5. The discharging portion 14 has the light source 141 and the light guide member 142 elongated in an axial direction D2 of the photosensitive drum 11. The light guide member 142 is longer than the photosensitive drum 11, and the longitudinal direction of the light guide member 142 is parallel with the axial direction D2 of the photosensitive drum 11.

The light source 141 is, for example, an LED light source that emits light for discharging the photosensitive drum 11. The light emitted from the light source 141 enters a light incident surface 143 formed at one end of the light guide member 142 in the longitudinal direction. In the light guide member 142, the light that enters from the one end at which the light incident surface 143 is formed is guided toward an end surface 144 at the other end while being repeatedly reflected. In the present embodiment, a case where the light source 141 is provided at one end of the light guide member 142 is described as an example. However, a configuration in which the light source 141 is provided at both ends of the light guide member 142 and light enters from both of the light incident surface 143 and the end surface 144 is also possible as another embodiment.

Figure 5A:
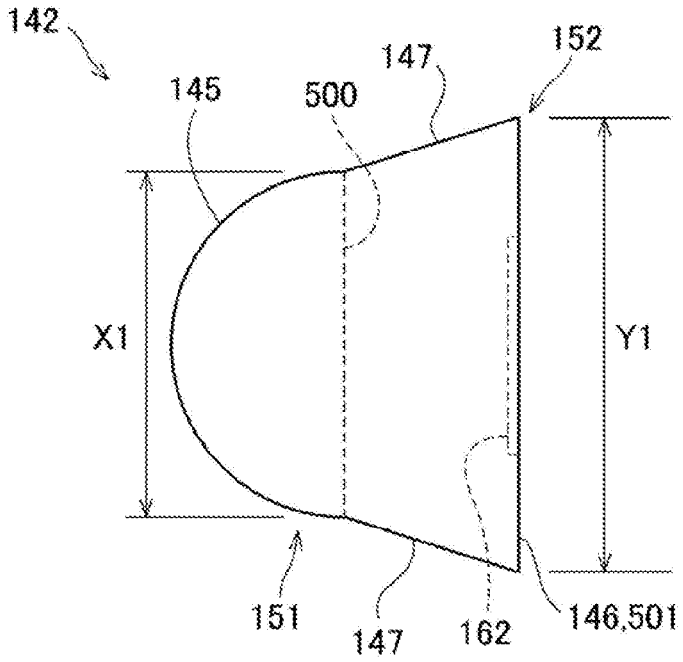
FIG. 5A is a diagram illustrating a cross-sectional shape of the light guide member illustrated in FIG. 3.

As shown in FIG. 5A, the light guide member 142 includes: a semicircular portion 151 that is formed of a material such as resin and has a semicircular shape at a cross section orthogonal to the longitudinal direction; and a trapezoidal portion 152 having a trapezoidal shape at the cross section orthogonal to the longitudinal direction. The diameter of the semicircle as the cross-sectional shape of the semicircular portion 151 has the same length as the length of an upper base 500 of the trapezoid as the cross-sectional shape of the trapezoidal portion 152. The light guide member 142 has a shape in which the semicircular portion 151 and the trapezoidal portion 152 are joined at the diameter portion of the semicircle and the upper base 500 of the trapezoid.

The light guide member 142 has a first optical surface 145, a second optical surface 146, and third optical surfaces 147.

The first optical surface 145 is an arc-shaped curved surface that is a part of the outer periphery of the semicircular portion 151 at the cross section orthogonal to the longitudinal direction. The first optical surface 145 is an example of a first outer peripheral surface according to the present disclosure. The second optical surface 146 is a flat surface that is a part of the outer periphery of the trapezoidal portion 152 at the cross section orthogonal to the longitudinal direction, and corresponds to a lower base 501 of the trapezoidal portion 152.

The third optical surfaces 147 are flat surfaces corresponding to legs of the trapezoid as the cross-sectional shape of the trapezoidal portion 152. The third optical surfaces 147 expand from the both ends of the first optical surface 145 toward the second optical surface 146. That is, the width of the light guide member 142 is increased from the first optical surface 145 toward the second optical surface 146. The second optical surface 146 and the third optical surfaces 147 form a cross section having a trapezoidal shape in which a straight line connecting the both ends of the first optical surface 145 corresponds to the upper base 500 and the second optical surface 146 corresponds to the lower base 501. The third optical surfaces 147 are an example of second outer peripheral surfaces according to the present disclosure.

In the present embodiment, the light guide member 142 is disposed such that the first optical surface 145 faces the photosensitive drum 11 on the upstream side and the second optical surface 146 faces the photosensitive drum 11 on the downstream-side.

Figure 4A:
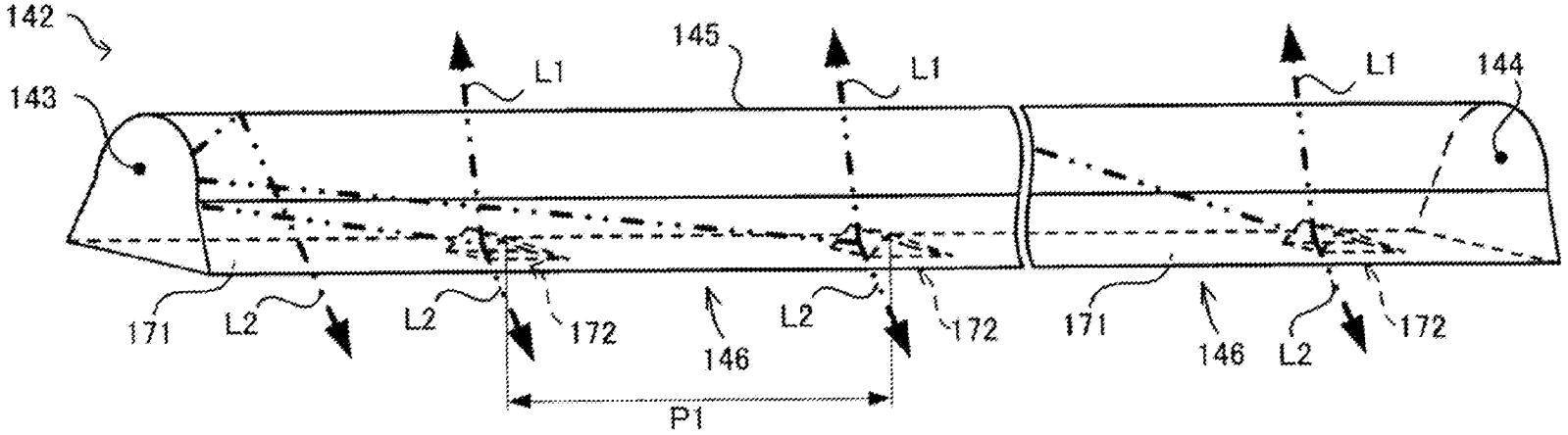
FIG. 4A and FIG. 4B are diagrams illustrating a light guide member of the discharging portion illustrated in FIG. 3.
Figure 4B:
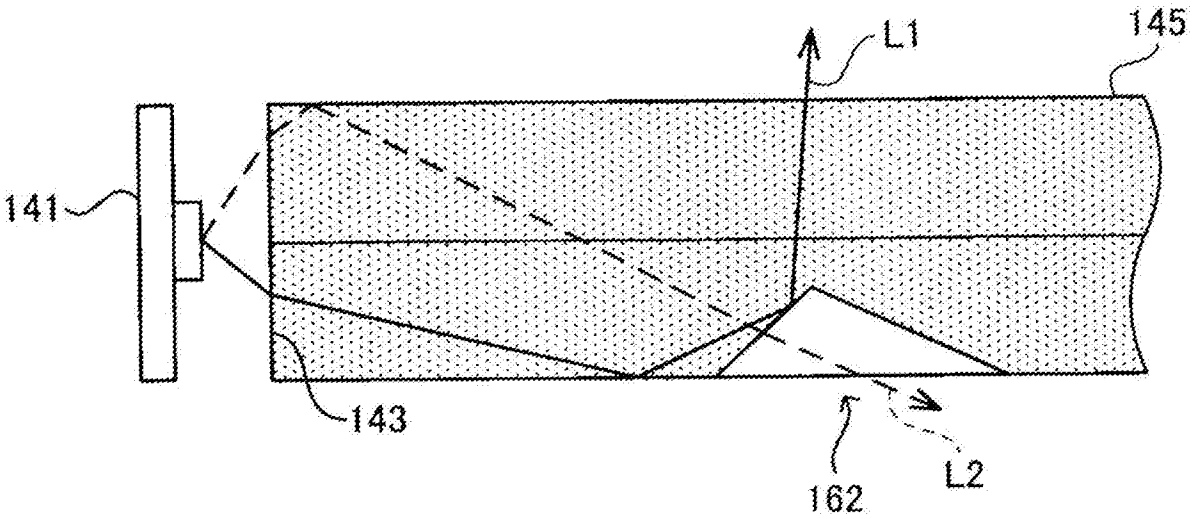

Specifically, the second optical surface 146 has a flat portion 171 and transmitting/reflecting portions 172. A plurality of transmitting/reflecting portions 172 are formed on the second optical surface 146 at predetermined intervals P1 in the longitudinal direction. Each of the transmitting/reflecting portions 172 is a groove having a triangular cross section and formed by inclined surfaces having a predetermined inclination angle inwardly from the flat portion 171. As shown in FIGS. 4A and 4B, when light traveling in the light guide member 142 enters the transmitting/reflecting portion 172, a part of the light is reflected by the transmitting/reflecting portion 172 and emitted as discharging light L1 from the first optical surface 145. Meanwhile, when the light traveling in the light guide member 142 enters the transmitting/reflecting portion 172, a part of the light is transmitted through the transmitting/reflecting portion 172 and emitted as discharging light L2 from the second optical surface 146. In the present embodiment, the intervals between the transmitting/reflecting portions 172 are equal to each other. However, in the light guide member 142, the amount of light gradually declines while the light emitted from the light source 141 and incident on the light guide member 142 is guided from one end to the other end. Therefore, in the light guide member 142, the intervals P1 at which the transmitting/reflecting portions 172 are formed in the longitudinal direction may become shorter as the distance from the light source 141 becomes longer. Thus, the amount of reflection and the amount of transmission of the light by the transmitting/reflecting portions 172 are increased at positions far from the light incident surface 143 of the light guide member 142, thereby achieving uniformity of the discharging light L1 and the discharging light L2 in the longitudinal direction of the light guide member 142.

Then, the discharging portion 14 causes the light emitted from the light source 141 to be reflected by the transmitting/reflecting portions 172, and causes the reflected light to be applied as the discharging light L1 to the position between the primary transfer roller 15 and the cleaning device 16 on the outer peripheral surface of the photosensitive drum 11 on the upstream side in the traveling direction D1 of the intermediate transfer belt 5. Meanwhile, in the discharging portion 14, the light emitted from the light source 141 is transmitted through the transmitting/reflecting portions 172, and the transmitted light is applied as the discharging light L2 to the position between the developing roller 131 and the primary transfer roller 15 on the outer peripheral surface of the photosensitive drum 11 on the downstream side in the traveling direction D1 of the intermediate transfer belt 5.

The inclination angle of the inclined surfaces of the transmitting/reflecting portions 172 is appropriately determined so that the amount of transmission and the amount of reflection of the light emitted from the light source 141, by the transmitting/reflecting portions 172, have a predetermined relationship. For example, the inclination angle of the transmitting/reflecting portions 172 is determined so that a ratio of the amount of the discharging light L1 that reaches the photosensitive drum 11 on the upstream side in the traveling direction D1 of the intermediate transfer belt 5 to the amount of the discharging light L2 that reaches the photosensitive drum 11 on the downstream side in the traveling direction D1 of the intermediate transfer belt 5 becomes 1:10.

Figure 5B:
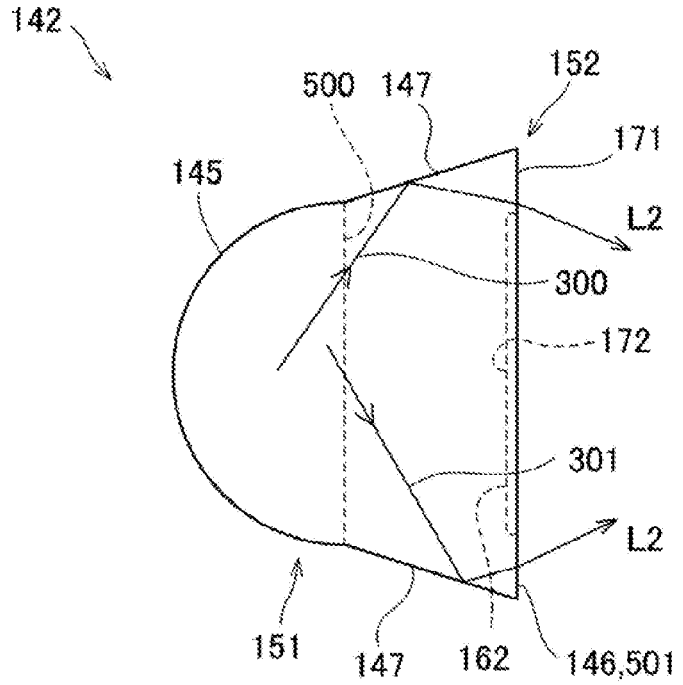
FIG. 5B is a diagram for explaining reflection and transmission of light inside the light guide member illustrated in FIG. 5A.

As shown in FIG. 5B, part 300, 301 of the light incident on the trapezoidal portion 152 enters the third optical surface 147. Part of the light that enters the third optical surface 147 is reflected by the third optical surface 147. Part of the light reflected by the third optical surface 147 enters the flat portion 171 or the transmitting/reflecting portion 172 of the second optical surface 146.

In the cylindrical-shape light guide member of the related art described above in which grooves each having a triangular cross section are arranged in parallel, light transmitted through the grooves is dispersed, resulting in less amount of light reaching the photosensitive drum. One of the causes of this phenomenon may be that, because the optical surface around each groove has an arc-shaped cross section, the incident angle of the light reflected by the optical surface to the groove is increased.

In contrast to the related art, in the image forming apparatus 10, since the width of the light guide member 142 is increased from the first optical surface 145 side toward the second optical surface 146 side, the incident angle of the light to the groove is decreased. Thus, the amount of the light transmitted through the second optical surface 146, i.e., the amount of the discharging light L2, is increased in the direction toward the position between the developing roller 131 and the primary transfer roller 15 on the outer peripheral surface of the photosensitive drum 11 on the downstream side in the traveling direction D1 of the intermediate transfer belt 5, as compared to that in the light guide member of the related art.

As described above, in the present embodiment, the discharging light L1 and the discharging light L2 for discharging the upstream-side photosensitive drum 11 and the downstream-side photosensitive dram 11, respectively, are supplied by the single light guide member 142. Thereby, the configuration for the pre-transfer discharging and the post-transfer discharging can be simplified. In addition, the width of the light guide member 142 is increased from the first optical surface 145 side toward the second optical surface 146 side. Thereby, the amount of the discharging light L2 can be increased.

By the way, the present discloser has discovered that the amount of the discharging light L2 can be further increased when a ratio (Y1/X1) of a length Y1 of the lower base 501 of the above-mentioned trapezoid to a length X1 of the diameter of the semicircle as the cross-sectional shape of the semicircular portion 151 is a predetermined specific ratio.

Figure 6:
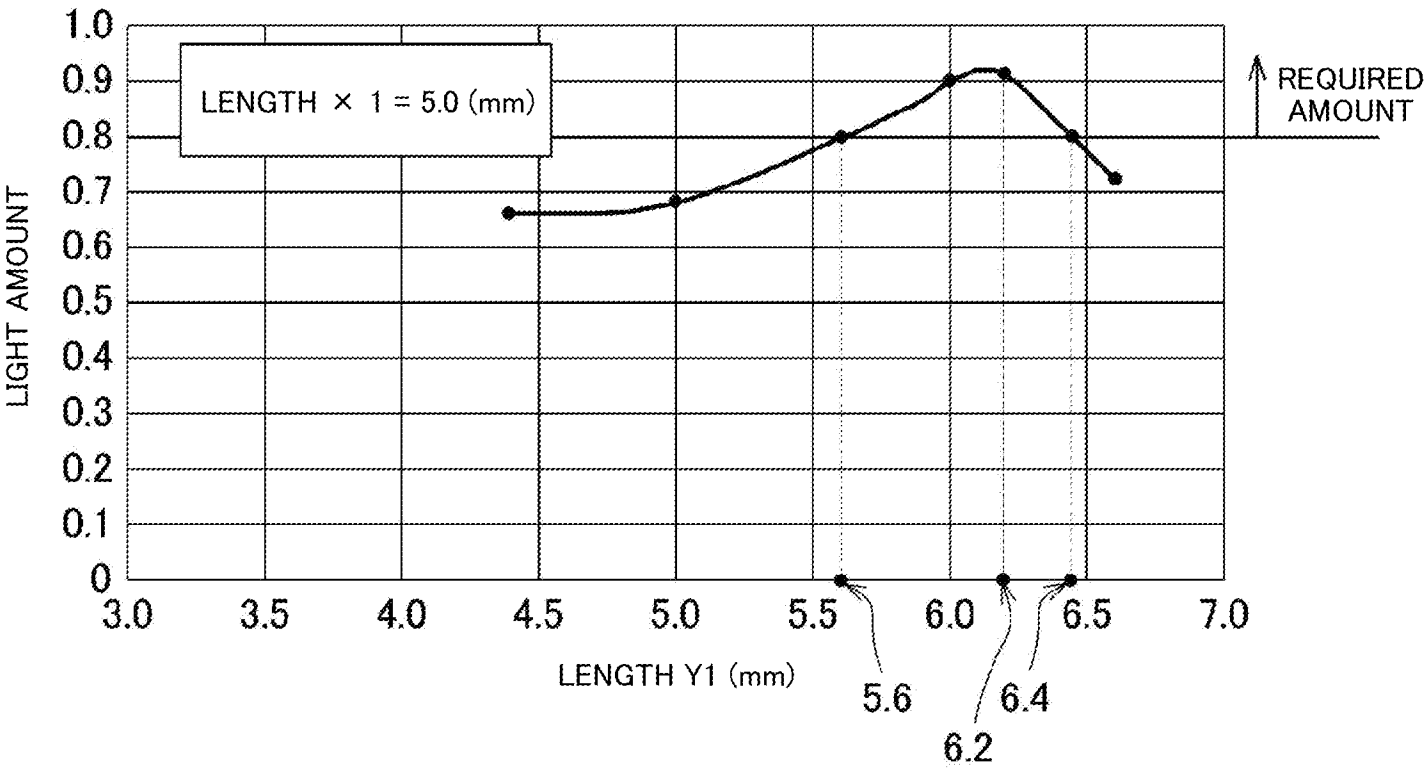
FIG. 6 is a diagram illustrating a verification result for a preferable range of the length of a lower base of a trapezoidal portion of the light guide member when the length of an upper base of the trapezoidal portion is 5 mm.

The present discloser has verified the amount of the discharging light L2 by use of multiple types of light guide members 142 with the length X1 being fixed to 5 mm and the length Y1 of the lower base 501 of the trapezoid being varied as shown in FIG. 6, for example. As the result of the verification, it is found that the preferable range of the length Y1 of the lower base 501 with which a desired amount of the discharging light L2 is obtained is not smaller than 5.6 mm but not larger than 6.4 mm, and the amount of the discharging light L2 is maximum when the length Y1 of the lower base 501 is 6.2 mm, as shown in FIG. 6. In this case, the specific ratio is not smaller than 1.12 but not larger than 1.28. In terms of the amount of the discharging light L2 according to the length Y1 of the lower base 501 of the light guide member 142, a large amount of the discharging light L2 is obtained most efficiently when the length Y1 of the lower base 501 is 6 mm. In this case, the specific ratio is 1.2.

Furthermore, the present discloser has verified the amount of the discharging light L2 by use of multiple types of light guide members 142 with both the length X1 and the length Y1 being varied, in a similar manner to that described above. As the result of the verification, it is found that, when the length X1 is not smaller than 3 mm but not larger than 6 mm (excluding 5 mm) which length is usually adopted, the preferable range of the length Y1 of the lower base 501 is not smaller than 3.3 mm but not larger than 7.2 mm. That is, the preferable length Y1 of the lower base 501 in the case where the length X1 of the diameter of the semicircle is 3 mm is 3.3 mm. In this case, the specific ratio is 1.1. In addition, the preferably length Y1 of the lower base 501 increases with an increase in the length X1, and the preferable length Y1 of the lower base 501 in the case where the length X1 is 6 mm is 7.2 mm. In this case, the specific ratio is 1.2. Accordingly, the specific ratio in the case where the length X1 is not smaller than 3 mm but not larger than 6 mm (excluding 5 mm) is not smaller than 1.1 but not larger than 1.2.

That is, when the length X1 is not smaller than 3 mm but not larger than 6 mm, the amount of the discharging light L2 can be further increased in the case where the ratio (Y1/X1) of the length Y1 to the length X1 is not smaller than 1.1 but not larger than 1.28.

As shown in FIG. 2, a transparent or semi-transparent light-transmitting member 17 is provided as a cover member that covers a part or the entirety of the light source 141 and the light guide member 142 of the discharging portion 14. The light-transmitting member 17 prevents dust or toner from attaching to the light source 141 and the light guide member 142 of the discharging portion 14, thereby making it possible to prolong the life time of the image forming apparatus 10.

An embodiment of the present disclosure has been described. However, the present disclosure is not limited to the contents described above, and various types of modifications can be made. Hereinafter, modifications of the present disclosure will be described.

[Modification 1]

The closer the transmitting/reflecting portion 172 is to the light source 141, the smaller the amount of light that transmits through the transmitting/reflecting portion 172. In other words, the farther the transmitting/reflecting portion 172 is from the light source 141, the greater the amount of light transmitting through the transmitting/reflecting portion 172. Therefore, it is conceivable to configure the light guide member 142 as shown in FIGS. 7A-7C or FIGS. 8A-8C. In FIGS. 7A-7C and 8A-8C, description for the transmitting/reflecting portions 172 is omitted.

In the light guide member 142 shown in FIG. 7A, the length Y1 of the lower base 501 is a length in the above-described preferable range at each position in the longitudinal direction of the light guide member 142, and the length Y1 decreases from a length L1 to a length L2 with distance from the light source 141 in the longitudinal direction. That is, the second optical surface 146 of the light guide member 142 has a shape having a width that decreases with distance from the light source 141. In the light guide member 142 shown in FIG. 7A, one side thereof in the width direction and the other side thereof in the width direction at a position farthest from the light source 141 are shorter by ΔW1 and ΔW2, respectively, as compared to the second optical surface 146 having the same length in the width direction over the longitudinal direction. The widths ΔW1 and ΔW2 may be equal to each other, or one of them may be larger than the other. Alternatively, as shown in FIG. 7B, in the light guide member 142, only one side thereof in the width direction at the position farthest from the light source 141 may be shorter by ΔW3 as compared to the second optical surface 146 having the same length in the width direction over the longitudinal direction. Still alternatively, as shown in FIG. 7C, in the light guide member 142, only the other side thereof in the width direction at the position farthest from the light source 141 may be shorter by ΔW4 as compared to the second optical surface 146 having the same length in the width direction over the longitudinal direction. In the light guide members 142 shown in FIGS. 7A-7C, the length of the diameter of the semicircular portion 151 is constant over the longitudinal direction.

In these light guide members 142, since the length Y1 of the lower base 501 is a length in the above-described preferable range at each position in the longitudinal direction, a desired amount of the discharging light L2 is emitted from each position on the second optical surface 146. However, since the length Y1 of the lower base 501 is decreased with distance from the light source 141 in the longitudinal direction, the amount of transmission of light at the second optical surface 146 decreases with distance from the light source 141.

As described above, as compared to the light guide member 142 in which the second optical surface 146 thereof has the uniform width L1, the amount of transmission of light at the second optical surface 146 at a position far from the light source 141 decreases to be approximated to the amount of transmission of light at the second optical surface 146 at a position close to the light source 141.

In the light guide member 142 shown in FIG. 8A, the length Y1 of the lower base 501 increases from a length L3 to a length L4 with distance from the light source 141 in the longitudinal direction. That is, the second optical surface 146 of the light guide member 142 has a shape having a width that increases with distance from the light source 141. In the light guide member 142 shown in FIG. 8A, one side thereof in the width direction and the other side thereof in the width direction at a position farthest from the light source 141 are longer by ΔW5 and ΔW6, respectively, as compared to the second optical surface 146 having the same length in the width direction over the longitudinal direction. The widths ΔW5 and ΔW5 may be equal to each other, or one of them may be larger than the other. Further, as shown in FIG. 8B, in the light guide member 142, only one side thereof in the width direction at the position farthest from the light source 141 may be longer by ΔW7 as compared to the second optical surface 146 having the same length in the width direction over the longitudinal direction. Further, as shown in FIG. 8C, in the light guide member 142, only the other side thereof in the width direction at the position farthest from the light source 141 may be longer by ΔW8 as compared to the second optical surface 146 having the same length in the width direction over the longitudinal direction. In the light guide members 142 shown in FIGS. 8A to 8C, the length of the diameter of the semicircular portion 151 is constant over the longitudinal direction.

Each of these light guide members 142 is, at a predetermined position in the longitudinal direction, separated into a first portion 200 in which the above-mentioned desired amount of the discharging light L2 is emitted from the second optical surface 146, and a second portion 201 in which a smaller amount of the discharging light L2 than the desired amount is emitted from the second optical surface 146. That is, of the first portion 200 and the second portion 201, in the first portion 200 closer to the light source 141, the length Y1 of the lower base 501 of the second optical surface 146 is a length in the above-described preferable range, and the desired amount of the discharging light L2 is emitted from the second optical surface 146. Meanwhile, in the second portion 201, the length Y1 of the lower base 501 of the second optical surface 146 is a length outside the preferable range, and a smaller amount of the discharging light L2 than the desired amount is emitted from the second optical surface 146.

As described above, as compared to the light guide member 142 in which the second optical surface 146 thereof has a uniform width, the amount of transmission of light in the second optical surface 146 at the second portion 201 is decreased, and approximated to the amount of transmission of light in the second optical surface 146 at the first portion 200.

As described above, as compared to the light guide member 142 in which the second optical surface 146 thereof has a uniform width, the amount of transmission of light at the second optical surface 146 at a position far from the incident surface 143 decreases, whereby uniformity of the discharging light L2 in the longitudinal direction of the light guide member 142 is achieved.

The light guide member 142 shown in FIGS. 7A-7C needs a smaller space for the light guide member 142 as compared to the light guide member 142 shown in FIGS. 8A-C. Therefore, the light guide member 142 shown in FIGS. 7A-7C is preferred to that shown in FIGS. 8A-8C.

[Modification 2]

The above embodiment has been described for the configuration in which the third optical surfaces 147 of the light guide member 142 expand from the both ends of the first optical surface 145 toward the second optical surface 146 at the same inclination angle. On the other hand, in the configuration in which the width of the light guide member 142 is increased from the first optical surface 145 toward the second optical surface 146, the two third optical surfaces 147 may have different inclination angles. For example, a configuration of the light guide member 142 in which one of the third optical surfaces 147 is orthogonal to the second optical surface 146 as shown in FIGS. 9A and 9B is conceivable as a modification. Thus, the present disclosure is also applicable to a case where size-reduction of the light guide member 142 is required because of an installation space of the light guide member 142.

[Modification 3]

It is also conceivable that the light guide member 142 is disposed so as to be rotated by 180 degrees. That is, it is conceivable that the discharging portion 14 causes the light emitted from the light source 141 to be reflected by the transmitting/reflecting portion 172, and causes the reflected light to be applied as the discharging light L2 to a position between the developing roller 131 and the primary transfer roller 15 on the outer peripheral surface of the photosensitive drum 11 on the downstream side in the traveling direction D1 of the intermediate transfer belt 5. In this case, the discharging portion 14 causes the light emitted from the light source 141 to be transmitted through the transmitting/reflecting portion 172, and causes the transmitted light to be applied as the discharging light L1 to a position between the primary transfer roller 15 and the cleaning device 16 on the outer peripheral surface of the photosensitive drum 11 on the upstream side in the traveling direction D1 of the intermediate transfer belt 5.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a plurality of image carriers arranged along a traveling direction of a transfer target member;

a developing roller configured to develop, as a toner image, an electrostatic latent image formed on each image carrier;

a transfer roller configured to transfer the toner image formed on each image carrier onto the transfer target member;

a cleaning portion configured to clean each image carrier after the toner image is transferred onto the transfer target member by the transfer roller;

a light source configured to emit light used to discharge each image carrier; and an elongated light guide member, wherein the light guide member comprises:

a transmitting/reflecting portion configured to transmit and reflect light that is emitted from each light source to enter one end of the light guide member in a longitudinal direction and be guided to the other end thereof in the longitudinal direction, so that the light is applied to: a position between the developing roller and the transfer roller on the image carrier on a downstream side in the traveling direction of the transfer target member; and a position between the transfer roller and the cleaning portion on the image carrier on an upstream side in the traveling direction of the transfer target member;

a first optical surface from which the light reflected by the transmitting/reflecting portion is emitted;

a second optical surface from which the light transmitted through the transmitting/reflecting portion is emitted; and at a cross section orthogonal to the longitudinal direction, an arc-shaped first outer peripheral surface including the first optical surface, and second outer peripheral surfaces expanding from both ends of the first outer peripheral surface toward the second optical surface.

2. The image forming apparatus according to claim 1, wherein the second outer peripheral surface, at the cross section, has a trapezoidal shape in which a straight line connecting the both ends of the first outer peripheral surface is an upper base, and the second optical surface is a lower base.

3. The image forming apparatus according to claim 1, wherein, at the cross section, a ratio of a width of the second optical surface to a length of a straight line connecting the both ends of the first outer peripheral surface is a predetermined specific ratio.

4. The image forming apparatus according to claim 1, wherein a width of the second optical surface is decreased with distance from the light source.

5. The image forming apparatus according to claim 1, wherein a width of the second optical surface is increased with distance from the light source.

6. The image forming apparatus according to claim 1, wherein one of the second outer peripheral surfaces is orthogonal to the second optical surface.

7. The image forming apparatus according to claim 1, wherein the transmitting/reflecting portion is a groove that has a triangular cross section and is formed inwardly from the second optical surface.

8. The image forming apparatus according to claim 1, wherein the transmitting/reflecting portion reflects the light emitted from the light source, as discharging light for discharging the image carrier, to a position between the transfer roller and the cleaning portion on an outer peripheral surface of the image carrier on the upstream side in the traveling direction of the transfer target member, and transmits the light emitted from the light source, as discharging light for discharging the image carrier, to a position between the developing roller and the transfer roller on the outer peripheral surface of the image carrier on the downstream side in the traveling direction of the transfer target member.

9. The image forming apparatus according to claim 1, wherein the transmitting/reflecting portion transmits the light emitted from the light source, as discharging light for discharging the image carrier, to a position between the transfer roller and the cleaning portion on an outer peripheral surface of the image carrier on the upstream side in the traveling direction of the transfer target member, and reflects the light emitted from the light source, as discharging light for discharging the image carrier, to a position between the developing roller and the transfer roller on the outer peripheral surface of the image carrier on the downstream side in the traveling direction of the transfer target member.

10. An elongated light guide member used in an image forming apparatus comprising: a plurality of image carriers arranged along a traveling direction of a transfer target member; a developing roller configured to develop, as a toner image, an electrostatic latent image formed on each image carrier; a transfer roller configured to transfer the toner image formed on each image carrier onto the transfer target member; a cleaning portion configured to clean each image carrier after the toner image is transferred onto the transfer target member by the transfer roller; a light source configured to emit light used to discharge each image carrier; and an elongated light guide member, the light guide member comprising:

a transmitting/reflecting portion configured to transmit and reflect light that is emitted from the light source to enter one end of the light guide member in a longitudinal direction and be guided to the other end thereof in the longitudinal direction, so that the light is applied to: a position between the developing roller and the transfer roller on the image carrier on a downstream side in the traveling direction of the transfer target member; and a position between the transfer roller and the cleaning portion on the image carrier on an upstream side in the traveling direction of the transfer target member;

a first optical surface from which the light reflected by the transmitting/reflecting portion is emitted;

a second optical surface from which the light transmitted through the transmitting/reflecting portion is emitted; and at a cross section orthogonal to the longitudinal direction, an arc-shaped first outer peripheral surface including the first optical surface, and second outer peripheral surfaces expanding from both ends of the first outer peripheral surface toward the second optical surface.

* * * * *